United States Patent [19]

Bernstein

[11] Patent Number: 4,483,064

[45] Date of Patent: Nov. 20, 1984

[54] PROCESS OF MULTIPLE FUSE CONSTRUCTION

[75] Inventor: Elliot Bernstein, Rockville Centre, N.Y.

[73] Assignee: Bel Fuse, Inc., Jersey City, N.J.

[21] Appl. No.: 431,017

[22] Filed: Sep. 30, 1982

Related U.S. Application Data

[63] Continuation-in-part of Ser. No. 400,605, Jul. 22, 1982, abandoned.

[51] Int. Cl.[3] ..... H01H 69/02

[52] U.S. Cl. ..... 29/623; 29/613; 29/618; 337/186

[58] Field of Search ..... 29/623, 618, 613, 877, 29/884; 337/186, 187, 198, 203, 159, 160, 161, 162, 164, 292, 293, 294, 229, 230, 237; 339/147 R, 147 C, 147 P

[56] References Cited

U.S. PATENT DOCUMENTS

| | | | |
|---|---|---|---|
| 1,605,688 | 11/1926 | Olin et al. | 29/623 |
| 2,292,117 | 8/1942 | Grimshaw | 29/623 |
| 2,711,464 | 6/1955 | Anderson et al. | 29/623 |
| 2,910,766 | 11/1959 | Pritikin | 29/613 |
| 3,023,289 | 2/1962 | McAlister | 29/623 |
| 3,500,276 | 3/1970 | Hingorany et al. | 337/293 |
| 3,641,666 | 2/1972 | Scaminaci, Jr. et al. | 29/884 |
| 3,742,987 | 7/1973 | Tarbox et al. | 29/884 |
| 4,071,837 | 1/1978 | Ranzanigo | 337/293 |
| 4,146,861 | 3/1979 | Arikawa et al. | 337/295 |
| 4,203,200 | 5/1980 | Wiebe | 29/623 |
| 4,337,570 | 7/1982 | Woznica | 29/623 |
| 4,349,805 | 9/1982 | Arikawa | 337/198 |

FOREIGN PATENT DOCUMENTS

| | | | |
|---|---|---|---|
| 2081031 | 2/1982 | United Kingdom | 29/623 |

*Primary Examiner*—Howard N. Goldberg
*Assistant Examiner*—P. W. Echols
*Attorney, Agent, or Firm*—Ostrolenk, Faber, Gerb & Soffen

[57] ABSTRACT

A fuse manufactured in multiple by insertion of pairs of fuse pins in rows in a base block or in discrete fuse bases supported by a plate which aligns them in rows; winding fuse wires successively along the pins and securing the fuse wires to the pins with the fuse wire between adjacent pairs of pins constituting the fuse link; removing the remaining fuse wire from between pins which are to form adjacent fuses, placing a body member with a cavity over each fuse link and placing a cover thereon. Where a single base block is used, the laminated structure is cut apart into a multiplicity of fuses. Where needed, an extinguishing powder may be sifted on prior to placement of the cover to complete the structure. Where desired, the fuse body and the cover sheet may be vented with an additional cover strip over the vent which will yield to excess pressure. Fuse blocks with multiple fuses of the same or different values may be thus created.

9 Claims, 10 Drawing Figures

FIG. 1.
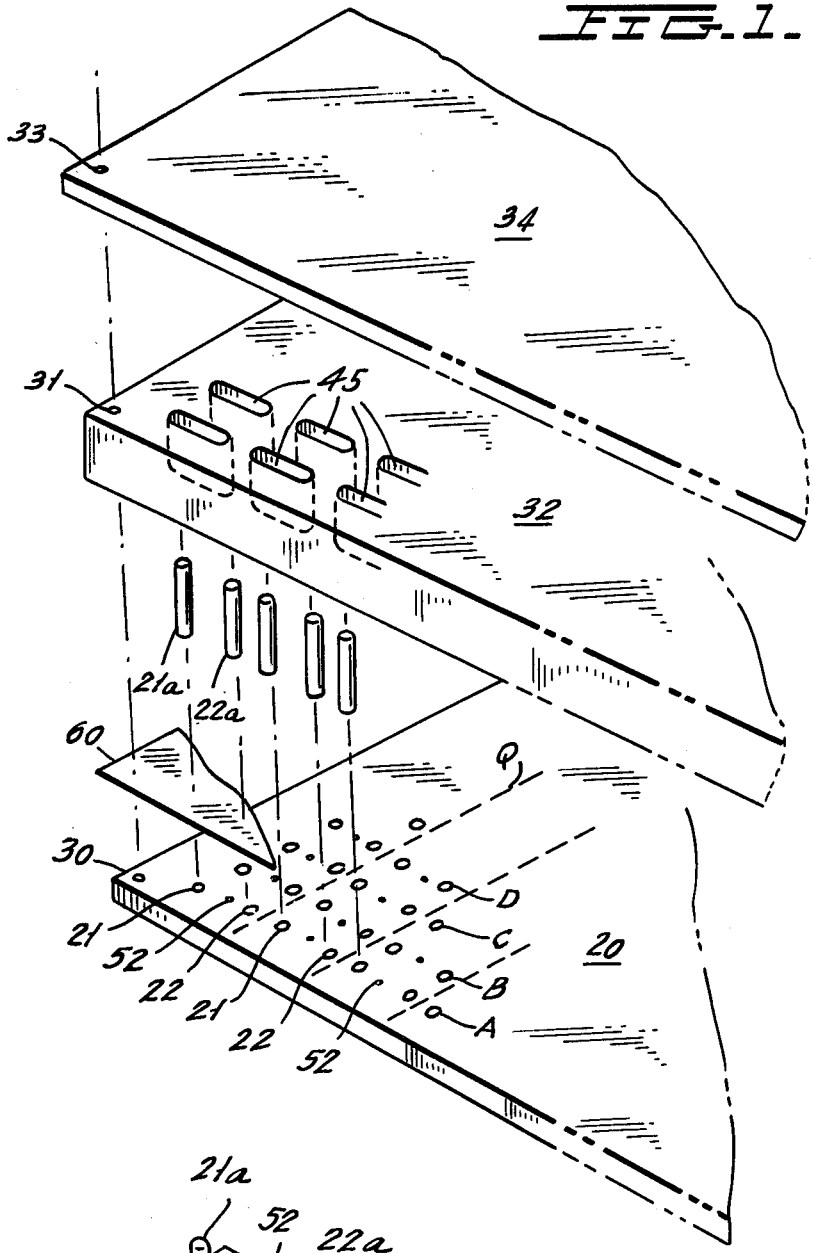
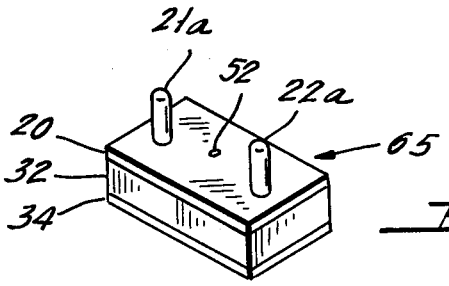
FIG. 6.

PROCESS OF MULTIPLE FUSE CONSTRUCTION

This application is a continuation-in-part of my pending application Ser. No. 400,605, now abandoned, filed July 22, 1982 for "Multiple Block Fuse".

The present invention relates to fuses and more particularly to the method for making fuses in a manner such that they may be manufactured economically and at the same time produce completed fuses which will pass the standard tests for efficacy, be readily insertable, easily removable and replaceable and be capable, after having been formed in multiple, of further processing where desired.

Essentially, the manufacture of fuses has been an individual operation in which fuses, even though automatically formed, are formed sequentially by first providing a body or support for the fuse, electrodes at each end of the body, connecting a fusible element between the electrodes and providing connecting elements for the fuse so that it may be inserted in a circuit where such insertion cannot conveniently use the electrodes at the end of the fuse body. Attempts have been made, particularly in the case of smaller fuses, to facilitate the manufacture of fuses and make fuses in multiple set-ups. Such attempts, however, have been limited to structures primarily in which the fusible element has been formed as a series of elements such as a comb-like structure which may be encased, connected and then cut apart.

The present invention is directed to a method for forming a large number of fuses in essentially a single operation, wherein each fuse has a capability of being individually used. In one form, a matrix plate is provided having means for positioning a multiplicity of fuse bases with connecting pins appropriately inserted through the bases. The fuses are formed directly on the bases located on the matrix and when completed, may be individually used. In another form, a base plate is provided with a body section laminated thereto having multiple cavities and a cover section. The fuses are formed directly on the base plate and when completed, may be cut apart to be individually operable. In this latter case where fuses are formed each with a pair of connecting elements, a set of 25 pairs of elements in each of 20 different rows will provide for the formation of 500 fuses simultaneously.

Similarly, where a matrix support plate is provided, a similar multiple set-up of fuse bodies may be treated to complete fuses and especially to place the fused link in position.

In the form in which the fuse is constructed as a block, the present invention contemplates a series of steps:

A suitable material is selected for the base. This material must be strong, non-conductive, non-tracking and non-flammable or self-extinguishing. The grade of material selected is determined by the requirements of the particular fuse to be constructed and the particular testing agencies which will be asked to approve the fuse and the particular specifications which the fuse must meet. Alignment holes are punched or otherwise formed in the base. These holes are used in subsequent operations to align the base with other components or equipment. The thickness of the base is determined by the strength required for the finished fuse and the strength of the material itself. The area of the base is determined by the relationship of the size of the finished fuse and the capabilities expected of the assembly equipment. Since the system contemplates constructing multiple fuses on the base, the sizes may vary from fuse to fuse and from machine to machine.

A series of holes for the electrodes are then punched or otherwise formed in any suitable manner in the base in parallel rows. The spacing between holes and between the rows is determined by the finished size of the particular fuses to be constructed. Electrodes are then pressed into these holes. The pressing in of the pins which are to form the electrodes may in the first instance create the holes which support them. Depending on the current rating of the fuse, the projected mounting means and the type of fuse link construction, these electrodes can be round, rectangular, square, solid or hollow or stamped to accept certain types of link construction on one side and certain types of socket receptacles on the other side. They will act as the terminals of the fuses and therefore are of conductive material.

In addition to being of different types of cross-section, each individual pin may itself vary in cross-section for different purposes having one cross-section at the area to which the fuse is anchored and another cross-section at the area of the pin which acts as the connector to the circuit.

In any such structure, multiple sets of fuses are intended to be formed. Where 25 pairs of pins have been mounted in each of 20 rows, this produces a structure which is capable of forming 500 fuses. The base, therefore, has a total number of pins that will eventually develop into 500 fuses. While mention has been made of punching or otherwise treating the base to form the holes for the pins, the base, of course, can be drilled, molded or cold formed with the holes and be developed from any material which is suitable for a fuse housing.

Fusible elements are then connected down each of the 20 rows of pins.

The same type of fuse link winding operation may be utilized where the fuses are to be formed as a block which is later to be separated or where the fuse bodies or especially their bases are placed on a support matrix for the operation:

The major consideration is to take advantage of the matrix thus formed to interconnect the pins with the fusible elements as quickly as possible and with as little labor as possible. For wire fuse link elements, a continuous wire can be fed out of hollow needles of the type which are known, for example, in the formation of coils and be wrapped around the first pin in each row. Either the set of needles or the base is then moved to align the second row of pins with the needles; wire is wrapped again on the second row and so on for the entire 50 pins in each row. The wire is then carried to another prepared base or, if the manufacturer wishes to use only one needle, the wire can be carried down the first row and returned back to the next row and then down the next row again and so on until all the rows have been taken care of.

This process may be used with standard coil winding hollow needles for fuses up to ten amps. Where a heavier fuse is required, multiple wires may be wound.

Instead of the utilization of multiple wires in order to produce a heavier fuse, it may be preferred to utilize fuse links which are dropped into place. To accomodate the fuse links, the terminals would then be changed to receive and position the links. The links themselves need not necessarily be dropped in individually. In accordance with the present invention, a single longitudinal link may be dropped onto a single longitudinal row of pins which will later be cut apart into separate fuses. In fact, an entire plate of fuse links may be dropped in to form the whole group of 500 fuses. In this case, the plate itself would necessarily initially be cut out, die cut, stamped or otherwise processed so that the fuse links would already have been pre-shaped prior to the dropping down of the plate on the electrodes or pins and would then be deposited in the fuse cavity as hereinafter described.

The fusible elements are then electrically connected to the pins or electrodes by suitable means such as dip soldering, welding, cold bonding, crimping or individual soldering, as required for the particular application. There may be fusible material remaining between what will eventually develop into separate fuses. This material can now be removed by cutting, blowing out electrically or other suitable means.

At this point in the assembly there may be a series of fuses supported on a support matrix or there may be a baseboard with 500 pairs of pins extending above the top of the board. Between each pair of pins is a fusible element connecting the pair. The pins extend through the board out the bottom to a length depending upon the projected mounting means to which the fuse is to be adapted. The projection of the pins on one side is for the connection of the fusible links between adjacent pins and the projection of the pins on the other side of the base is for the connection of the fuse which is to be formed to the intended circuit.

Obviously, the fuse link should be encased and for this purpose, the body section is placed over the base. The thickness of this section will depend on the cavity size necessary to meet the electrical requirements of the finished fuse, the size of the link and the length of the pins.

Both the base and the body sections are provided with aligning holes preferably at the corners so that guide pins may be used to align the base and the body section. The body section is provided with a plurality of cavities which have been formed in the body in a manner such that when the body is dropped on the aligning pins, each of these cavities will surround a pair of pins and form a protective receptacle around the fusible element. This body, as is obvious, can be a single sheet of material matching the base and of suitable thickness. Several thinner sheets may be aligned or bonded together if the required thickness is too great to effectively punch, drill or form the cavities. The body is then bonded by suitable means to the base.

An additional cover sheet is prepared with aligning holes which will match the aligning holes and aligning pins on the base and the body. This sheet acts as a cover for the upper surface of the structure and is bonded to the top of the body.

There is now provided an enclosed laminate containing 500 cavities in which each cavity contains a pair of pins that protrude out of the bottom of the laminate. A fusible element connects each pair of pins in a cavity. Before or after it is mounted in place, the cover sheet can be screened or printed in a single operation with 500 sets of descriptions, so that all fuses are identified in one operation. If desired, the cover can be bonded at the body before the body is bonded to the base. Also, if suitable material is available, the body and cover can be molded as a single structure.

The complete bonded structure is now fed through suitable cutting equipment which may include 20 blades on the X axis and 25 blades on the Y axis suitably spaced. This creates 500 individual fuses. These fuses can be tested before or after cutting and if desired, an appropriate fixture may be provided for testing all 500 fuses at one time. The base, cover and body can be preformed with break lines or openings so that the individual fuses can be broken off rather than cut apart.

Where a plurality of fuse bodies is formed on a base or matrix which supports the fuse bodies, the operation is essentially the same except that there is no need to cut the fuses apart after they are completed.

For those applications where many fuses are mounted in a single fuse block to protect a plurality of components such as in automobiles, a different rating of fusible material can be run down each row of pairs of pins and electrodes. When cutting the fuses apart, instead of cutting individual fuses, the fuses can then be cut apart in blocks containing a multiple series of fuses, permitting the user to handle only one component instead of many, simplifying inventory control, assembly and manufacturing operations.

In addition, by placing a third pin inside the cavities and running the fuse link serially from pin 3 to pin 2 to pin 1 of each cavity, a fuse could carry its own replacement. If the element fails between pins 1 and 2, the fuse can be lifted out and reconnected in its receptacle between pins 2 and 3, thereby providing an immediate replacement. As many replacements as desired may thus be made. Where material of suitable strength is available, the cover may be transparent to make easier identification of a blown fuse.

The construction is particularly adapted for those fuses requiring arc quenching powders, since it would be much simpler and quicker to fill 500 cavities through which the pins extend. The cover is then laminated to enclose the individually filled fuses.

For those fuses that must be vented, small holes may be drilled in the base between the terminals or in the cover before lamination or pin insertion. A layer of thin film may be laminated over the base or under the cover, covering the holes. After lamination, the film would be inside the fuse. If gas pressure builds up to too high a level inside the fuse, the film will rupture, permitting venting to the atmosphere. Note that this is a safety procedure to prevent the fuse body from flying apart. If the pressure built up within the fuse body can be contained by the fuse body, then ideally the film will not rupture. The film is preferably so arranged that if there is a possibility that the pressure within the fuse body on blowing of the fuse should approach the rupture point of the fuse body, then the film will rupture to permit the venting to occur.

The method has been described above in general terms apart from specific objects and is clearly understandable from such description without necessarily referring to drawings.

The principal object of the present invention is the formation of fuses in a multiple operation. They may be formed as a multiple block which must then be separated into separate fuses or as a plurality of individual fuses mounted on a support or matrix which may be treated as a unitary structure until the fuses are completed.

The foregoing and many other objects of the present invention will now be obvious from the following description and accompanying drawings, in which:

FIG. 1 is a schematic illustration in perspective of the principal method for forming the fuses of the present invention;

FIG. 1*a* is a top plan view of the central body member mounted on the base and showing the cavities which contain the pins and fuse link;

FIG. 6 is a view in perspective of a fuse formed by the structure and method shown in FIGS. 1–5;

Figure 1A:
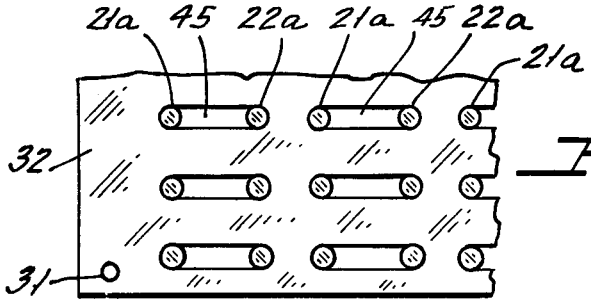
Figure 7:
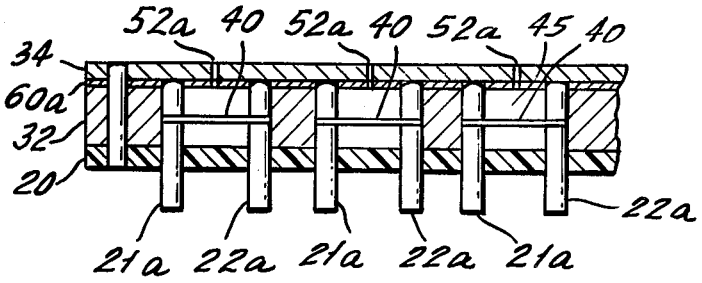
FIG. 7 is a view corresponding to that of FIG. 5 showing, however, the venting sheet adjacent to or laminated inside the top cover rather than connected to the base.
Figure 8:
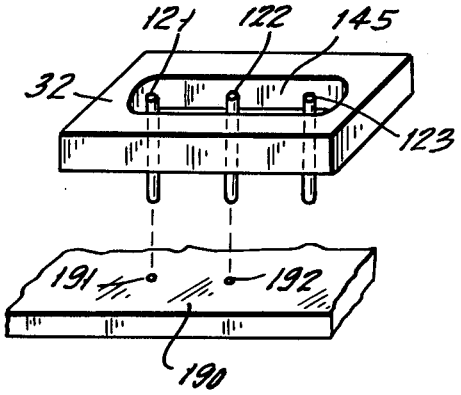
Figure 9:
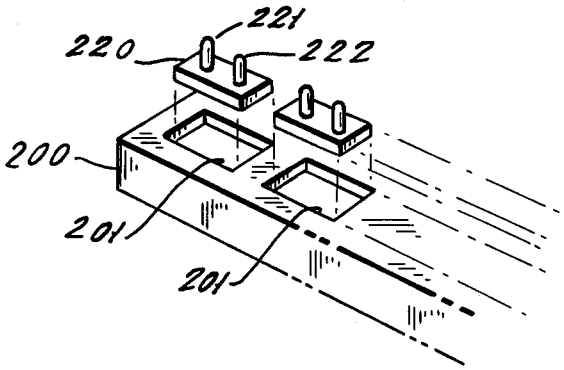

FIG. 8 is a partial view of a fuse having two fuse links and three terminals arranged so that the same structure may be used by a simple reversal after one of the fuse links has blown; and FIG. 9 is a view corresponding to that of FIG. 1 where instead of a single block being formed, the base matrix plate is provided to support a plurality of fuses which may then be treated in the manner hereinafter described in connection with FIGS. 1–7.

Figure 2:
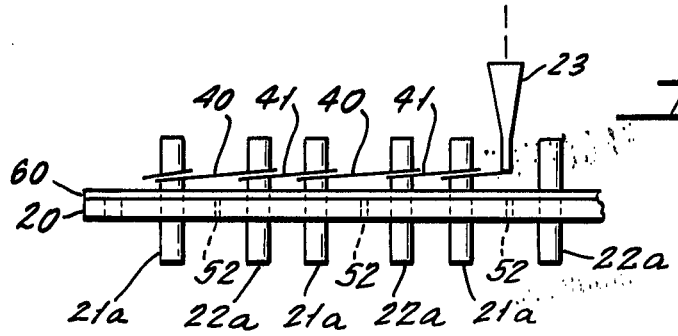
FIG. 2 is a schematic view showing a spinning needle ejecting the fuse link wire and winding the same successively around the pins.

Referring to the drawings, the base 20 is formed with a series of holes 21, 22. Each adjacent pair of holes 21, 22 guides the formation of a single fuse. These holes are arranged in various rows, such as row A, B, C, D, etc. to obtain the desired number of fuses in the single structure. The holes may be precast or preformed in any suitable manner and as previously described the terminal element 21*a* and 22*a* may be inserted and positioned therein, being appropriately secured thereto and passing through both sides, as shown in FIG. 2. The holes may also be formed by insertion of terminal elements 21*a* and 22*a*.

Thereafter, the needle 23 (FIG. 2) of a wire winding machine may attach the fuse link by taking a number of turns around successive pins 21*a*, 22*a*, 21*a*, 22*a* down each row and then moving over to the next row, etc. For this purpose, the base plate 20 may be moved where the wire winding needle 23 is stationary, or the wire winding needle 23 may be moved in order to accomplish this result. It will be noted also that the base plate 20 is provided with aligning holes 30 which will match the aligning holes 31 in the fuse body plate 32 and the aligning holes 33 in the cover plate 34.

It should be borne in mind that instead of using a single needle, 25 parallel needles may be used in order to provide a winding of the complete base on a single pass.

After the fuse link wire 40 has been wound between adjacent pins, the wire may be secured to the pins in any suitable manner by individual crimping, cold welding, soldering or dip soldering. The plate 20 may thus be removed from the winding machine in order to further secure the interconnection of the fuse link wire 40 and the pins.

In addition to other methods of effecting a secure connection between the pins and the fuse links as the winding needle moves down relatively to the entire plate or the plate moves relatively to the winding needle, a soldering mechanism can be utilized to come down to solder the fuse link to a pin which has just been wound as the winding mechanism leaves the particular pin. The attachment of the fuse link material to the pin may be in any suitable manner in addition to soldering or in place of soldering as, for instance, by welding, cold welding, crimping or any other manner which is utilized in order to form a firm electromechanical connection. Thus, when a completion of the winding operation for the base plate has occurred, the soldering operation can also have been completed.

Figure 3:
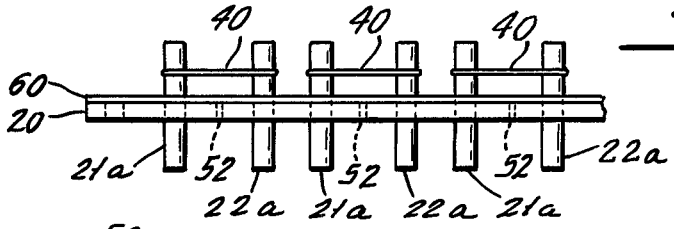
FIG. 3 is a schematic view showing the fuse link wires connected between a pair of terminals, the wire between adjacent fuse elements having been cut away.

Thereafter, as shown in FIG. 3, the sections of fuse link wire 41 between adjacent fuses are cut away in any suitable manner and removed. The aligning holes 30 of the plate 20 are then used in connection with the aligning holes 31 of the body 32 to permit the body 32 to be dropped down over the tops of the pins and over the fuses with the cavities 45 in plate 32 forming receptacles for the fuse elements. It should be borne in mind that the cavities 45 are cut all the way through the plate 32. The base 20 forms a floor for each of the cavities. Thus, the device which forms the cavities in the plate 32 need not be specially controlled to form a mere cavity with a bottom. The bottom is provided by the plate 20 on which the plate 32 rests. Appropriate lamination of the plates may include the utilization of appropriate adhesive or other means of interconnecting the plates so that the fuse links 40 are completely sealed inside the base 20 and fuse body 32.

The cavities for the fuses are illustrated as oblong. It will be obvious that they may have any desired shape including even a circular shape since some small fuses have such a shape. The essential element is that a pair of pins extend into the cavity forming on the bottom of the fuse a means for interconnecting the fuse with a circuit and, above the base of the fuse, a support for the fuse link.

Figure 4:
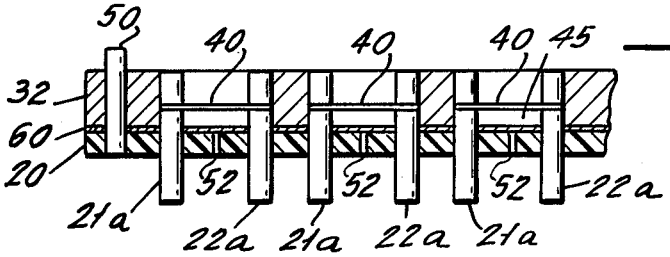
FIG. 4 is a schematic view showing a fuse body supported on the base and secured thereto and aligned therewith.
Figure 5:
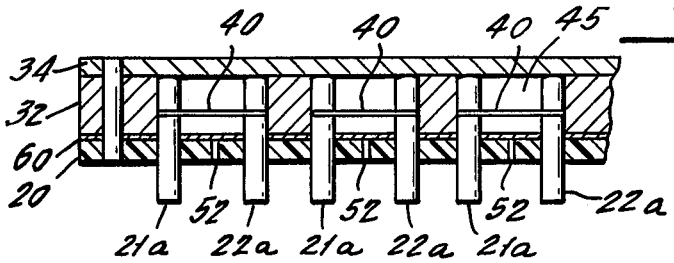
FIG. 5 is an alternate view showing the fuse body supported on the base with vent holes in the fuse body.

The aligning pins 50 have been indicated particuarly in FIGS. 4 and 5 to show how they are used in connection with the aligning holes 30, 31 and 33 of the different layers of the elements. Thereafter, the cover sheet 34 is deposited on the body 32 in order to complete the structure.

Where it may be desirable or necessary to vent the fuse, a cover sheet may be provided in connection with an appropriate venting opening in the fuse base or cover. As a preferred method of venting the fuse, each pair of adjacent pin holes 21, 22 in the base for supporting the pins or electrodes for any one fuse have provided between them a vent hole 52, so that the fuse may be vented in the event that it requires venting. Such vent hole may of course be omitted where venting is not believed to be necessary for a particular fuse. However, where such venting is required to prevent rupture of the fuse body, then a rupturable element to permit venting may be utilized. For this purpose, after the pins 21, 22 are inserted, a sheet 60 having appropriate openings to permit it to drop over the pin holes 21, 22 is laminated onto the base 20, thereby providing a cover for the vent holes 52 or to the cover 34 (FIG. 7). Thereafter, in the finished fuse when pressure within the cavity of the fuse builds up sufficiently to require venting, the sheet 60 may rupture at the entry to the vent hole 52 and permit such venting to occur. The tensile strength and other characteristics of the sheet 60 are chosen to permit the sheet to preferably rupture under increased pressure or at least to burn away during the blowing of the fuse, so that the gases may vent through the opening 52 in the base without destroying the fuse body. It is preferable to place the vent hole in the base so that a person who may happen to be leaning over the structure at the time a fuse blows does not receive the venting blast. However, under certain circumstances and for certain types of panelboard mounting, it may be desirable to have the venting at the upper side of the fuse. In such cases and where specified, the venting sheet 60*a* instead of being placed on the base prior to the placement of a cavity body 32 thereon may be placed on top of the cavity body and vent holes 52*a* appropriately spaced in the cover body 34 may be used in the same way. It should be noted that the protective sheet is present as a safety measure to permit the venting to occur where pressures are expected to build up to a point where the fuse assembly might rupture. Also, under certain circumstances where it does not happen to be desirable to have the venting sheet extend to the edge of the fuse, venting strips may be utilized in place of the venting sheet; but the usual expected operation would entail the dropping down of a single sheet of such character that it may readily rupture to provide a venting operation.

Where an arc extinguishing powder is utilized, it will be obvious that it may be simply sifted over the top of the plate 32 after the plate 32 is in position. The powder will then be deposited in the cavities 45 and the excess brushed away. With the positioning of the cover plate 34 and the lamination thereof to the plate 32, the fuse with its arc extinguishing powder will be completed.

In FIG. 8 there is shown a fuse construction which has previously been alluded to in which three pins 121, 122, 123 are provided in the cavity 145 of the fuse body 32. The pins extend below the base as shown. One pair of pins as, for instance, 121, 122 may be used for connection to the chassis 190 through connector clips 191, 192. In the event that the fuse link between pins 121 and 122 is blown, then the fuse may be taken out and reversed so that pins 123 and 122 are engaged with the connectors 191, 192 of the chassis 190 and thereby reinsert a fuse in the circuit. In this way, the fuse body carries its own spare.

In FIG. 9 there is shown a method by which the Econcept of utilizing the single winding operation by moving either the base or a winding needle or moving them with respect to each other in order to form a multiple set of fuses is applied to the formation of groups of individual fuses on a single matrix or at a single pass. In order to accomplish this operation, as shown in FIG. 9, a matrix base 200 is provided with a series of guide openings 201 conforming to the shape of the fuse to be formed. The base 220 of each fuse to be formed is then dropped into the guide opening 201 with the pins already passed therethrough and once the matrix plate 200 is filled up, then the operation of forming the fuses is that already described, particularly in connection with FIG. 2. On the completion of the operation, the individual fuses may then be removed from the matrix. There may also be a hybrid type of operation in which the fuse bodies may individually be dropped on the fuse bases or a plate which will eventually become the fuse bodies may be dropped. Similarly, the cover plate may be dropped on the body as a single unit or individual cover plate may be dropped. In the latter case, means must be provided for separating the individual fuses after they are formed. Where, however, individual fuse bodies and individual cover plates are dropped in place, no further separation is required and then the essential element which is in common between the FIG. 9 structure and the FIGS. 1–7 structure is the utilization of the single winding operation for forming a plurality of fuses.

It will thus be seen that by this means a simplified method is provided for forming a large number of fuses by the utilization of existing mechanisms. The kind of winding needle which has previously been used for winding coils is now used for winding successive turns of the fusible link wire around successive pins in the correct order. The 500 fuse plate may be moved with respect to the fuse link winder or the fuse link winder may be moved with respect to the plate itself or a plurality of fuse link winding elements may be used in a manner now well known in the art in the case of winding or resistors. There is no need for preforming the links in the form of a comb or other structure or providing special means for attaching electrodes. When the entire structure is cut apart by cutting along two different axes, 500 fuses or more may be formed at a single time, each having the shape shown in FIG. 6.

Where multiple fuses are to be used in a single structure, the fuse links may be wound from appropriate fuse link wire in adjacent rows so that fuse blocks may be formed which can be handled as a unit for insertion and replacement of multiple fuses. The fuse links of different fuses in the block may be of different capacities to protect different types of circuits.

The fuse itself may be formed so that it has a third terminal so that if the fuse link between terminals 1 and 2 should fail, the fuse may be taken from the chassis and reinserted with terminals 2 and 3 in place in order to promptly restore the circuit if it is capable of restoration.

The cover sheet and the body member may be made in part transparent so that a simplified determination can be made as to which fuse has blown.

In the foregoing, the present invention has been described solely in connection with preferred illustrative embodiments thereof. Since many modifications and variations in the present invention will now be obvious to those skilled in the art, it is preferred that the scope of this invention be determined not by the specific disclosures herein contained, but only by the appended claims.

What is claimed is:

1. The method of manufacturing fuses in multiple comprising the placement of pairs of pins in rows along a block of insulating material, wherein the pins extend on both sides of said block, arranging fuse links between adjacent pins, thereby forming a fuse link between pairs of pins which are eventually to form a fuse, applying a body member on the side of said block carrying the fuse links, enclosing the fuse links and securing the body member to said block and then cutting fuses apart along two axes on said block to form a plurality of fuses.

2. The method of manufacturing fuses as claimed in claim 1, wherein the fuses are cut apart in multiples to form a fuse block having multiple fuses.

3. The method of manufacturing fuses as claimed in claim 2, wherein adjacent fuses are formed with fuse links of different capacity, so that the block thus formed will have a plurality of fuses at least one pair of which is of different capacity.

4. The method of manufacturing fuses as claimed in claim 1, wherein a cover sheet for the body plate is provided and in which the body plate has cavities receiving the ends of the pins to which the fuse link is attached, said base plate having vent openings, and means for covering said vent openings yieldable to predetermined pressure within the fuse.

5. The method of manufacturing fuses as claimed in claim 1, wherein a plurality of cavities are provided in the body for each adjacent pair of pins to form the fuse and arc extinguishing material is deposited in each of said cavities.

6. The method of manufacturing a fuse as claimed in claim 1, wherein a block having support sections for individual fuses is provided and a continuous fuse link depositing device is provided; the block and the fuse link depositing device being movable with respect to each other; said method comprising the steps of placing at least a base portion of a fuse with at least a pair of pins extending from each base portion on said block and; adjacent base portions and pairs of pins being aligned in rows on X and Y axes and moving the block, the base support member and the fuse winding device with respect to each other to interconnect adjacent pins in rows, thereafter severing alternate connections between the pins, leaving each pair of pins with a single connection between said pair of pins.

7. The method of manufacturing fuses in multiple comprising the placement of pairs of pins in rows along a block of insulated material wherein the pins extend on both sides of said block, connecting fuse wire to form fuse links between adjacent pins, thereby forming a fuse link between pairs of pins which are eventually to form a fuse, removing the fuse wire between adjacent pins of adjacent fuses, applying a body member on the side of said block carrying the fuse links and securing the body member thereto; the said body member having cavities outlining the fuse links, covering said fuse links by a cover member secured to the body member and then cutting fuses apart along two axes on said block to form a plurality of fuses.

8. The method of manufacturing fuses as claimed in claim 7, wherein the fuses are cut apart in multiples to form a fuse block having multiple fuses.

9. The method of manufacturing fuses as claimed in claim 8, wherein adjacent fuses are formed with fuse links of different capacity, so that the block thus formed will have a plurality of fuses at least one of which is of different capacity from the other.

* * * * *